US012635725B2

(12) United States Patent
Seo et al.

(10) Patent No.: US 12,635,725 B2
(45) Date of Patent: May 26, 2026

(54) AEROSOL-GENERATING ROD COMPRISING TOBACCO STRANDS ARRANGED IN PARALLEL

(71) Applicant: KT&G CORPORATION, Daejeon (KR)

(72) Inventors: Jung Kyu Seo, Daejeon (KR); Tae Chul Shin, Daejeon (KR); Young Rim Han, Daejeon (KR); Do Kyong Lee, Daejeon (KR); Jae Sung Noh, Chungcheongnam-do (KR); Hee Tae Jung, Chungcheongbuk-do (KR)

(73) Assignee: KT&G CORPORATION, Daejeon (KR)

( * ) Notice: Subject to any disclaimer, the term of this patent is extended or adjusted under 35 U.S.C. 154(b) by 1045 days.

(21) Appl. No.: 17/051,357

(22) PCT Filed: Sep. 27, 2019

(86) PCT No.: PCT/KR2019/012586
§ 371 (c)(1),
(2) Date: Oct. 28, 2020

(87) PCT Pub. No.: WO2020/067766
PCT Pub. Date: Apr. 2, 2020

(65) Prior Publication Data

US 2021/0092990 A1 Apr. 1, 2021

(30) Foreign Application Priority Data

Sep. 28, 2018 (KR) ..... 10-2018-0116578

(51) Int. Cl.
*A24C 5/01* (2020.01)
*A24B 3/14* (2006.01)
(Continued)

(52) U.S. Cl.
CPC ..... *A24C 5/01* (2020.01); *A24B 3/14* (2013.01); *A24D 1/20* (2020.01); *A24D 3/17* (2020.01)

(58) Field of Classification Search
None
See application file for complete search history.

(56) References Cited

U.S. PATENT DOCUMENTS 4,981,522 A 1/1991 Nichols et al.
8,863,754 B2 10/2014 Renaud et al.
(Continued)

FOREIGN PATENT DOCUMENTS

CN 102762118 A 10/2012
CN 106136305 A 11/2016
(Continued)

OTHER PUBLICATIONS

Newspaper article, retrieved from http://news_joins.com/article/22089794, Nov. 7, 2017, 3 pages.
(Continued)

*Primary Examiner* — Katherine A Will
(74) *Attorney, Agent, or Firm* — Sughrue Mion, PLLC

(57) ABSTRACT

Disclosed is an aerosol-generating rod, in which a medium portion includes a plurality of strands, the medium portion and a filter portion are connected in a longitudinal direction of the aerosol-generating rod, and the plurality of strands are arranged parallel to each other in the longitudinal direction.

7 Claims, 5 Drawing Sheets

(51) Int. Cl.
*A24D 1/20* (2020.01)
*A24D 3/17* (2020.01)

(56) References Cited

U.S. PATENT DOCUMENTS

| | | | | |
|---|---|---|---|---|
| 10,327,473 | B2 | 6/2019 | Mironov | |
| 10,426,197 | B2 | 10/2019 | Thorens | |
| 2014/0166032 | A1 | 6/2014 | Gindrat | |
| 2016/0309782 | A1 | 10/2016 | Malgat et al. | |
| 2017/0055576 | A1 | 3/2017 | Beeson et al. | |
| 2018/0125113 | A1* | 5/2018 | Minzoni | A24D 1/02 |
| 2020/0093177 | A1 | 3/2020 | Han et al. | |
| 2020/0253286 | A1* | 8/2020 | Woodman | A24C 5/1828 |
| 2021/0267267 | A1* | 9/2021 | Brifcani | A24C 5/1885 |

FOREIGN PATENT DOCUMENTS

| | | | |
|---|---|---|---|
| CN | 107809921 | A | 3/2018 |
| CN | 108135289 | A | 6/2018 |
| CN | 207604513 | U | 7/2018 |
| CN | 207836767 | U | 9/2018 |
| EP | 0 246 107 | A2 | 11/1987 |
| JP | 2013-519384 | A | 5/2013 |
| JP | 6000451 | B2 | 9/2016 |
| KR | 10-2013-0024886 | A | 3/2013 |
| KR | 10-2016-0003283 | A | 1/2016 |
| KR | 10-2018-0044407 | A | 5/2018 |
| KR | 10-2018-0070458 | A | 6/2018 |
| WO | 2009/022232 | A2 | 2/2009 |

OTHER PUBLICATIONS

International search report for PCT/KR2019/012586 dated Jan. 13, 2020.

Office Action issued Jul. 6, 2022 in Chinese Application No. 201980028712.5.

Extended European Search Report issued Aug. 4, 2021 in European Application No. 19865116.8.

Office Action issued Sep. 14, 2021 in Japanese Application No. 2020-556937.

Office Action dated Oct. 25, 2021 in KR Patent Application No. 10-2018-0116578.

Office Action dated Dec. 22, 2021 in CN Patent Application No. 201980028712.5.

* cited by examiner

AEROSOL-GENERATING ROD COMPRISING TOBACCO STRANDS ARRANGED IN PARALLEL

CROSS-REFERENCE TO RELATED APPLICATIONS

This application is a National Stage of International Application No. PCT/KR2019/012586 filed on Sep. 27, 2019, which claims priority under U.S.C. § 119 (a) to Korean Patent Application No. 10-2018-0116578 filed on Sep. 28, 2018.

TECHNICAL FIELD

The present disclosure relates to an aerosol-generating rod including tobacco strands arranged in parallel.

BACKGROUND ART

Recently, the demand for alternative methods to overcome the shortcomings of general cigarettes has increased. For example, there is growing demand for a method of generating aerosol by heating an aerosol generating material in cigarettes, rather than by combusting cigarettes. Accordingly, studies on a heating-type cigarette and a heating-type aerosol generating device have been actively conducted.

In general, a medium portion of a heating-type cigarette or heating-type aerosol-generating rod may be filled with reconstituted tobacco sheets, shredded tobacco which is finely cut from a reconstituted tobacco sheet, or tobacco strands cut elongatedly from a reconstituted tobacco sheet.

In the case where the medium portion is filled with the tobacco strands, when the tobacco strands are arranged in a random direction, problems such as quality deviation due to a random arrangement, non-uniformity of an amount of atomization, and deterioration of a cigarette taste quality may occur.

DESCRIPTION OF EMBODIMENTS

Technical Problem

Various embodiments provide an aerosol-generating rod including tobacco strands arranged in parallel. Meanwhile, technical problems to be achieved by the present disclosure are not limited to the technical problems as described above, and other technical problems may be inferred from the following embodiments.

Solution to Problem

In an aerosol-generating rod according to one aspect, the aerosol-generating rod may include a medium portion including at least one aerosol-generating material; and a filter portion connected in a longitudinal direction to one end of the medium portion, wherein the medium portion includes a plurality of strands, and the plurality of strands may be arranged parallel to each other in the longitudinal direction.

In the aerosol-generating rod, the medium portion may include 100 or more of the plurality of strands, and a mass of the medium portion may be 200 mg or more.

In the aerosol-generating rod, a length of each of the plurality of strands may correspond to a length of the medium portion.

In the aerosol-generating rod, a density of each of the plurality of strands may be greater than or equal to 900 $mg/cm^3$ and less than 1100 $mg/cm^3$.

In the aerosol-generating rod, a ratio of a mass to a surface area of each of the plurality of strands may be greater than or equal to 0.05 $mg/mm^2$ and less than 0.09 $g/mm^2$.

In the aerosol-generating rod, each of the plurality of strands may have a width of 0.6 mm to 1.2 mm in the direction perpendicular to the longitudinal direction, and a thickness of 180 μm to 225 μm.

In the aerosol-generating rod, each of the plurality of strands may include an aerosol-generating material in an amount of 15% to 25% by weight.

In the aerosol-generating rod, each of the plurality of strands may further include at least one flavoring agent in an amount of 0% to 10% by weight.

In the aerosol-generating rod, a density of the medium portion may be 500 $mg/cm^3$ to 600 $mg/cm^3$.

In a method of manufacturing an aerosol-generating rod according to another aspect, the method of manufacturing an aerosol-generating rod may include shredding a reconstituted tobacco sheet to produce a plurality of strands; forming a medium portion by supplying the plurality of strands onto a wrapper and wrapping the plurality of strands with the wrapper; and connecting one end of the medium portion to a filter portion in a longitudinal direction of the aerosol-generating rod, wherein the plurality of strands may be arranged parallel to each other in the longitudinal direction.

Advantageous Effects of Disclosure

Embodiments according to the present disclosure may provide an aerosol-generating rod including tobacco strands arranged in parallel. In detail, a plurality of tobacco strands included in a medium portion of the aerosol-generating rod may be arranged parallel to each other in the longitudinal direction of the aerosol-generating rod. Accordingly, the airflow path may be sufficiently formed such that the aerosol may be generated more sufficiently and uniformly, compared with the case where the tobacco strands are randomly arranged. In addition, a surface carbonization phenomenon of the tobacco strands by the heat source of a heating type aerosol-generating device may be reduced, thereby improving a quality of a taste of cigarettes.

BEST MODE

In an aerosol-generating rod according to one aspect, the aerosol-generating rod may include a medium portion including at least one aerosol-generating material; and a filter portion connected in a longitudinal direction to one end of the medium portion, wherein the medium portion may include a plurality of strands, and the plurality of strands are arranged parallel to each other in the longitudinal direction.

Mode of Disclosure

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present invention will be described in detail with reference to the drawings.

Figure 1:
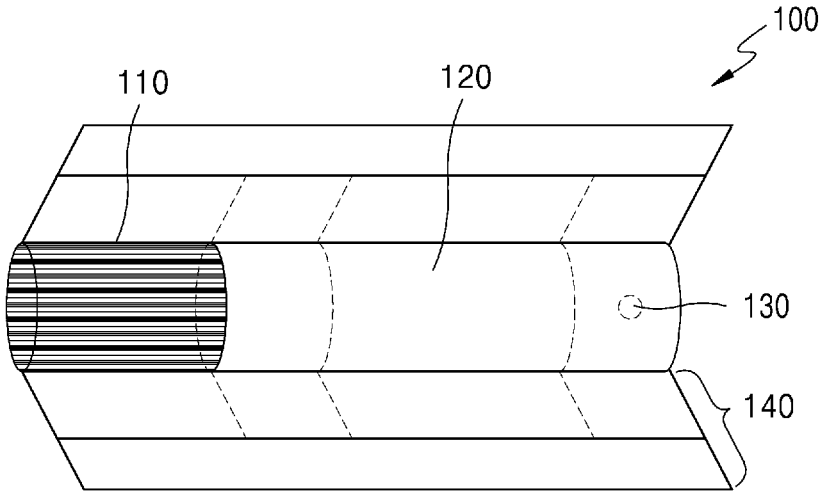
FIG. 1 is a diagram showing an example of an aerosol-generating rod.

FIG. 1 is a diagram showing an example of an aerosol-generating rod.

Referring to FIG. 1, the aerosol-generating rod 100 includes a medium portion 110 and a filter portion 120.

In FIG. 1, the filter portion 120 is illustrated as a single segment, but is not limited thereto. In other words, the filter portion 120 may include a plurality of segments. For example, the filter portion 120 may include a first segment for cooling an aerosol and a second segment for filtering a predetermined component included in the aerosol. In addition, if necessary, the filter portion 120 may further include at least one segment that performs other functions.

The aerosol-generating rod 100 may be packaged by at least one wrapper 140. The wrapper 140 may have at least one hole through which external air flows or internal gas flows out. As an example, the aerosol-generating rod 100 may be packaged by one wrapper 140. As another example, the aerosol-generating rod 100 may be packaged by overlapping two or more wrappers 140. For example, the medium portion 110 may be packaged by a first wrapper, and the filter portion 120 may be packaged by a second wrapper. Also, the medium portion 110 and the filter portion 120 packaged by individual wrappers are combined, and the entire aerosol-generating rod 100 may be repackaged by a third wrapper. When each of the medium portion 110 or the filter portion 120 is composed of a plurality of segments, each segment may be packaged by the individual wrapper. In addition, the entire aerosol-generating rod 100 in which segments packaged by the individual wrappers are combined may be repackaged by another wrapper.

The medium portion 110 may include an aerosol-generating material. For example, the aerosol-generating material may include at least one of glycerin, propylene glycol, ethylene glycol, dipropylene glycol, diethylene glycol, triethylene glycol, tetraethylene glycol, and oleyl alcohol, but is not limited thereto. Also, the medium portion 110 may contain other additives, such as flavors, wetting agents and/or organic acids. In addition, a flavoring liquid such as menthol or moisturizer may be added to the medium portion 110 by being sprayed on the medium portion 110.

The medium 110 may be manufactured in various ways. For example, the medium portion 110 may be made of a sheet, or may be made of strands. In addition, the medium portion 110 may be made of shredded tobacco which is finely cut from a tobacco sheet. Also, the medium portion 110 may be surrounded by a heat-conducting material. For example, the heat-conducting material may be a metal foil such as aluminum foil, but is not limited thereto. For example, the heat-conducting material surrounding the medium portion 110 may disperse heat transferred to the medium portion 110 to improve the thermal conductivity of the medium portion, thereby improving the taste of tobacco. In addition, the heat-conducting material surrounding the medium portion 110 may function as a susceptor heated by an induction heating type heater. Although not shown in the drawing, the medium portion 110 may further include an additional susceptor in addition to the heat conducting material surrounding the outside thereof.

The filter portion 120 may be a cellulose acetate filter. Moreover, the shape of the filter unit 120 is not limited. For example, the filter portion 120 may be a cylindrical type rod or a tube type rod including a hollow inside. Also, the filter portion 120 may be a recess type rod. When the filter portion 120 is composed of a plurality of segments, at least one of the plurality of segments may be manufactured in a different shape.

The filter portion 120 may be manufactured to produce flavor. As an example, the flavoring liquid may be sprayed on the filter portion 120, or a separate fiber coated with the flavoring liquid may be inserted into the filter portion 120.

In addition, the filter portion 120 may include at least one capsule 130. Here, the capsule 130 may perform a function of generating flavor or a function of generating an aerosol. For example, the capsule 130 may be a structure in which a liquid containing a flavor is wrapped with a film. The capsule 130 may have a spherical or cylindrical shape, but is not limited thereto.

In the case where the filter portion 120 includes a segment for cooling the aerosol, the cooling segment may be made of a polymer material or a biodegradable polymer material. For example, the cooling segment may be made of pure polylactic acid, but is not limited thereto. Alternatively, the cooling segment may be made of a cellulose acetate filter with a plurality of perforations. However, the cooling segment is not limited to the above-described example, and may be applied without limitation as long as the aerosol may perform a cooling function.

Figure 2:
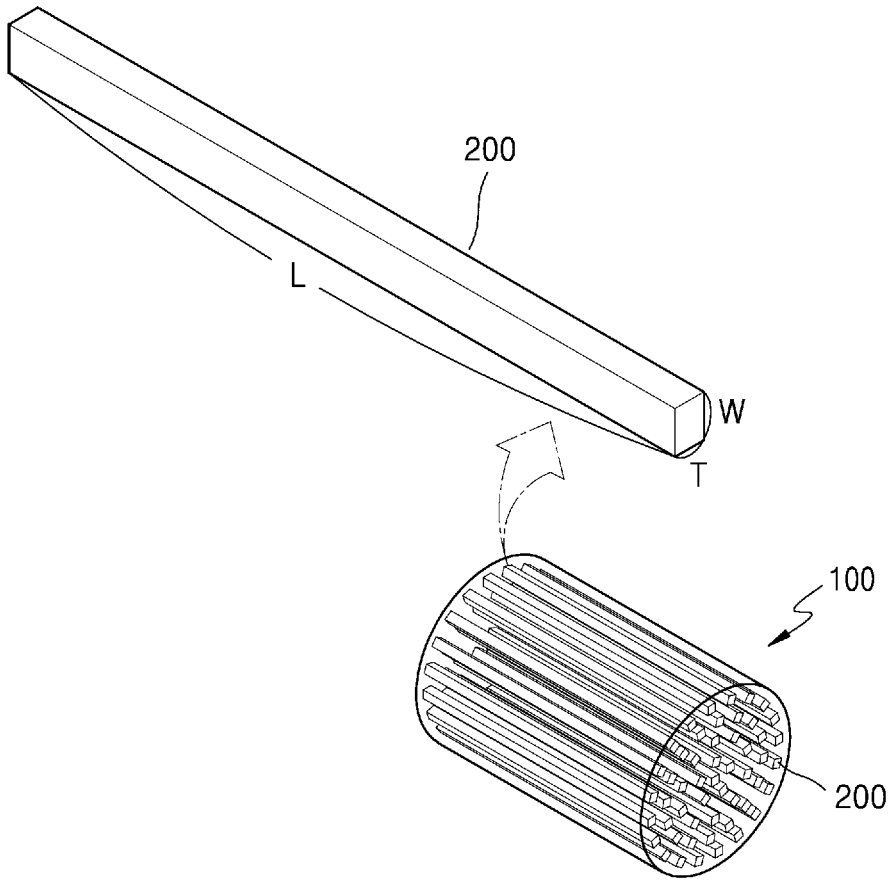
FIG. 2 is a diagram for explaining an example of a medium portion including a plurality of tobacco strands arranged parallel to each other in the longitudinal direction of an aerosol-generating rod.

FIG. 2 is a diagram for explaining an example of a medium portion including a plurality of tobacco strands arranged parallel to each other in the longitudinal direction of an aerosol-generating rod.

Referring to FIG. 2, a medium portion 110 including a plurality of tobacco strands 200 is illustrated. The tobacco strands 200 in the medium portion 110 may be arranged parallel to each other in the longitudinal direction. Here, the longitudinal direction means the longitudinal axis direction of the aerosol-generating rod 100 of FIG. 1. In other words, the tobacco strands 200 may be arranged parallel to each other in the longitudinal direction to which the medium portion 110 and the filter portion 120 are connected.

Assuming that the medium portion 110 has the same length and the same diameter, when the plurality of tobacco strands 200 are filled in parallel to each other in the longitudinal direction of the aerosol-generating rod 100, the medium portion 110 may include a larger number of tobacco strands 200 than when the plurality of tobacco strands 200 are filled in a random arrangement. Consequently, with the same amount of heat transferred to the medium portion 110, a greater amount of atomization may be generated when the plurality of tobacco strands 200 are filled in parallel to each other in the longitudinal direction of the aerosol-generating rod 100, compared with the case of a random filling arrangement.

In addition, when the plurality of tobacco strands 200 are arranged in the longitudinal direction of the aerosol-generating rod 100, the airflow path in the longitudinal direction in the medium portion 110 may be sufficiently secured. As such, the amount of atomization and a quality of a taste of cigarettes may be improved during smoking.

In addition, compared with the case where the plurality of tobacco strands 200 are filled in a random arrangement, when the plurality of tobacco strands 200 are arranged in the longitudinal direction of the aerosol-generating rod 100, the heater may be smoothly inserted into the aerosol-generating rod 100, and breakage of the heater and deformation or damage of the aerosol-generating rod 100 may be prevented. In addition, a change in frictional resistance according to the shape of the heater, which may occur when the plurality of tobacco strands 200 are randomly arranged, may be prevented.

The effect of the tobacco strands 200 being arranged in parallel in the longitudinal direction will be described in more detail with reference to FIGS. 3 and 4.

The medium portion 110 may have a long elongated cylindrical shape having a circular or elliptical cross section, and the length and diameter of the medium portion 110 may vary. For example, the length of the medium portion 110 may be 7 to 15 mm, and preferably 12 mm. The diameter of the medium portion 110 may be 5 to 9 mm, and preferably 7 mm. However, the length and diameter of the medium portion 110 are not limited to the above-described range.

The plurality of tobacco strands 200 may be manufactured by cutting a reconstituted tobacco sheet. In detail, the tobacco strand 200 may be manufactured by the following process. First, a tobacco raw material is crushed to generate a slurry in which an aerosol-generating substance (for example, glycerin, propylene glycol, etc.), a flavoring liquid, a binder (for example, guar gum, xanthan gum, Carboxymethyl cellulose (CMC), etc.), and water are mixed, and then a reconstituted tobacco sheet may be formed using the slurry. When making a slurry, natural pulp or cellulose may be added, and one or more binders may be mixed and used. Finally, after drying the formed reconstituted tobacco sheet, the tobacco strand 200 may be generated by cutting or shredding the dried reconstituted tobacco sheet The tobacco raw material may be fragments of tobacco leaf, tobacco stems, and/or fine tobacco powder generated during tobacco processing. Also, the reconstituted tobacco sheet may contain other additives such as wood cellulose fiber.

On the other hand, the medium portion 110 may be composed of about 80 to 160 tobacco strands 200, preferably 100 to 140 tobacco strands 200. More preferably, the medium portion 110 may be composed of 120 to 140 tobacco strands 200. However, the number of the tobacco strands 200 constituting the medium portion 110 is not limited to the above-described range.

A mass of the medium portion 110 may be 200 mg or more, and preferably may be 200 mg to 300 mg. In addition, the density of the medium portion 110 may be 400 mg/cm$^3$ to 700 mg/cm$^3$, preferably 500 mg/cm$^3$ to 600 mg/cm$^3$. Meanwhile, the mass and density of the medium portion 110 are not limited to the above-described numerical range.

In FIG. 2, as an example of the tobacco strand 200, a cuboid shape having a rectangular cross-section and having a predetermined width (W), thickness (T), and length (L) is shown. However, the shape of the tobacco strand 200 is not limited thereto, and the cross section of the tobacco strand 200 may be various shapes such as a circle.

When the tobacco strand 200 is a shape of a cuboid, the width W may be 0.5 mm to 1.5 mm, preferably 0.6 mm to 1.2 mm. In addition, the thickness (T) of the tobacco strand 200 may be 150 μm to 600 μm, preferably 180 μm to 225 μm. In addition, the length (L) of the tobacco strand 200 may be 2 mm to 15 mm, preferably 10 mm to 14 mm. Meanwhile, the numerical ranges of the width (W), the thickness (T), and the length (L) of the tobacco strand 200 are not limited to those described above.

For example, the length of the tobacco strand 200 according to an embodiment may correspond to the length of the medium portion in the direction in which the air flows in the aerosol-generating rod 100. When the length of the tobacco strand 200 and the length of the medium portion 110 are the same, an air flow path may be secured from the upstream end to the downstream end of the medium portion 110 in the longitudinal direction of the aerosol-generating rod 100. The term "upstream" means a direction away from the mouth of the user who inhales the aerosol generated from the aerosol-generating rod 100 and The term "downstream" means a direction toward the mouth of a user who inhales the aerosol generated from the aerosol-generating rod 100. Therefore, the hot air moves through the air flow path formed from the upstream end to the downstream end of the medium portion 110, so that heat may be uniformly and efficiently transferred.

In addition, the density of the tobacco strand 200 may be 800 mg/cm$^3$ to 1200 mg/cm$^3$, preferably 900 mg/cm3 or more and less than 1100 mg/cm$^3$. However, the density of the tobacco strand 200 is not limited to the above-described range.

On the other hand, the ratio of the mass to the surface area of the tobacco strand 200 may be determined by the shape and density of the tobacco strand 200, and the tobacco strand 200 of the present invention may have a ratio of mass to surface area of 0.05 mg/mm$^2$ to 0.15 mg/mm$^2$. More preferably, the tobacco strand 200 may have a ratio of mass to surface area of 0.05 mg/mm$^2$ or more and less than 0.09 mg/mm$^2$. However, the ratio of the mass to the surface area of the tobacco strand 200 is not limited to the above-described range.

The ratio of the mass to the high surface area of the tobacco strands 200 according to the present invention may reduce the local temperature increase phenomenon of the tobacco strands 200 due to hot air heated by a heat source or a heat conducting element.

The tobacco strand 200 may include an aerosol-generating material in an amount of 10% to 30% by weight, and more preferably 15% to 25% by weight.

In addition, the tobacco strands 200 may contain other additives, such as flavoring agents, wetting agents and/or organic acids. For example, flavoring agents are licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, coriander or coffee. In addition, the wetting agent may include glycerin or propylene glycol.

The tobacco strand 200 may include one or more flavoring agents in an amount of 0 to 10% by weight.

Figure 3A:
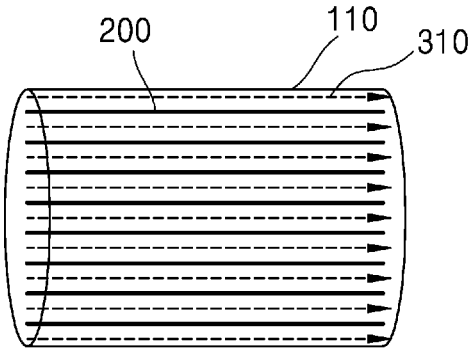
FIGS. 3A-3B are diagrams for explaining an example of an air flow path formed in a medium portion including a plurality of tobacco strands.
Figure 3B:
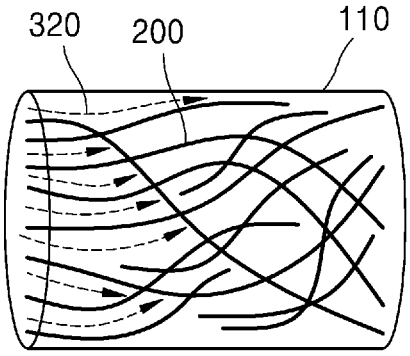

FIGS. 3A-3B are diagrams for explaining an example of an air flow path formed in a medium portion including a plurality of tobacco strands.

FIG. 3A is a diagram showing an example of the air flow path formed when a plurality of tobacco strands 200 are arranged parallel to each other in the longitudinal direction of the aerosol-generating rod 100 within the medium portion 110, and FIG. 3B is a diagram illustrating an example of the airflow path formed when a plurality of tobacco strands 200 are arranged in a random direction within the medium portion 110.

Referring to FIG. 3A, as the plurality of tobacco strands 200 are arranged parallel to each other in the longitudinal direction of the aerosol-generating rod 100, a airflow path may be sufficiently formed in the longitudinal direction of the aerosol-generating rod 100. Accordingly, the aerosol may be generated sufficiently and uniformly, during smoking.

On the other hand, referring to FIG. 3B, as the plurality of tobacco strands 200 are arranged in a random direction, it is difficult to secure the airflow path and the direction of the airflow path may be formed in a random direction. Therefore, the amount of atomization may be small or non-uniform compared with the aerosol-generating rod including the medium portion of FIG. 3A, and the quality deviation between the aerosol-generating rods may be large.

On the other hand, the aerosol-generating rod 100 may be heated by a conductive heat transfer, heat dissipative heat transfer or convective heat transfer from a heat source (e.g., a heater) or a heat conducting element. When hot air heated by the heat source or the heat-conducting element moves through the air flow path in the medium portion 110 and convective heat transfer occurs, there is a possibility that the plurality of tobacco strands 200 are locally overheated. Such local overheating may cause combustion or thermal decomposition of a portion of the tobacco strands 200, which may result in hot spots.

As shown in FIG. 3A, when the plurality of tobacco strands 200 in the medium portion 110 are arranged parallel to each other in the longitudinal direction of the aerosol-generating rod 100, the airflow path 310 is formed in the longitudinal direction of the aerosol-generating rod 100. Consequently, since hot air is less likely to be trapped between the tobacco strands 200, surface carbonization due to a heat source such as a hot spot may be reduced.

On the other hand, in the case of FIG. 3B, since the plurality of tobacco strands 200 within the medium portion 110 are randomly arranged, the aerosol may not pass the air flow path 320 smoothly. Therefore, it is highly likely that the aerosol generated in the medium portion 110 will be trapped between the tobacco strands 200 arranged in a random direction. As a result, combustion or thermal decomposition occurs in some of the tobacco strands 200, and thus a quality of a taste of cigarettes may be deteriorated.

Meanwhile, a heater may be inserted into the aerosol-generating rod 100 to heat the aerosol-generating rod 100. In this case, as shown in FIG. 3A, when a plurality of tobacco strands 200 are arranged parallel to each other in the medium portion 110, the direction in which the tobacco strands 200 are arranged and the direction in which the heater is inserted are the same. Therefore, the heater may be smoothly inserted into the aerosol-generating rod 100, and damage to the heater and deformation of or damage to the aerosol-generating rod 100 may be prevented. Conversely, as shown in FIG. 3(*b*), when a plurality of tobacco strands 200 are randomly arranged, the direction in which the tobacco strands 200 are arranged may not be the same as the direction in which the heater is inserted. Accordingly, when the heater is inserted into the aerosol-generating rod 100, it is likely that the heater may be damaged or the aerosol-generating rod 100 may be deformed or damaged.

In addition, as shown in FIG. 3A, when a plurality of tobacco strands 200 are arranged in parallel to each other in the medium portion 110, a frictional resistance of the heater is low regardless of the shape of the heater. Therefore, the heater may be smoothly inserted into the aerosol-generating rod 100. However, as shown in FIG. 3B, when a plurality of tobacco strands 200 are randomly arranged, the frictional resistance may differ depending on the shape of the heater. Therefore, the heater may not be smoothly inserted into the aerosol-generating rod 100.

Figure 4:
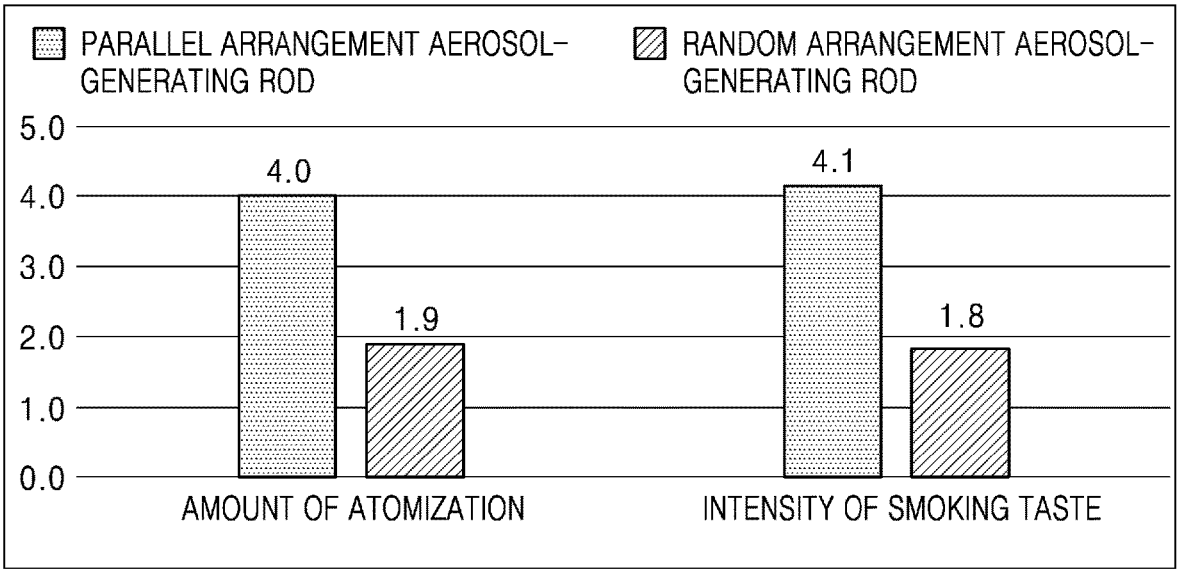
FIG. 4 is a diagram for explaining an example of an amount of atomization and an intensity of a smoking taste when a plurality of tobacco strands are arranged parallel to each other in the longitudinal direction of an aerosol-generating rod.

FIG. 4 is a diagram for explaining an example of an amount of atomization and intensity of a smoking taste when a plurality of tobacco strands are arranged parallel to each other in the longitudinal direction of the aerosol-generating rod.

FIG. 4 is a graph showing the average value of the amount of atomization and the intensity of smoking taste for each of the parallel arrangement aerosol-generating rod 100 and random arrangement aerosol-generating rod 100, according to Table 1 below.

TABLE 1

| | amount of atomization | | intensity of smoking taste | |
|---|---|---|---|---|
| | parallel arrangement aerosol-generating rod | random arrangement aerosol-generating rod | parallel arrangement aerosol-generating rod | random arrangement aerosol-generating rod |
| 1 | 4 | 1.5 | 4.2 | 1.5 |
| 2 | 3.7 | 2 | 3.8 | 2 |
| 3 | 4 | 1.5 | 4.5 | 1.5 |
| 4 | 4.5 | 2 | 4 | 1.5 |
| 5 | 3.7 | 2.3 | 4 | 2 |
| 6 | 4 | 1.8 | 4.2 | 2 |
| 7 | 4.2 | 2 | 4 | 1.5 |
| 8 | 4 | 2.5 | 4.5 | 2 |
| 9 | 3.8 | 1.5 | 3.8 | 1.8 |
| 10 | 4.5 | 1.7 | 4 | 2 |
| 11 | 4 | 1.8 | 4.2 | 2 |
| 12 | 4.2 | 2 | 4 | 1.5 |
| 13 | 4 | 2.5 | 4.5 | 2 |
| 14 | 3.8 | 1.5 | 3.8 | 1.8 |
| 15 | 4 | 1.7 | 4.5 | 2 |
| . . . | | | | |
| Average | 4.0 | 1.9 | 4.1 | 1.8 |

Table 1 is a table showing a sensory evaluation results of the amount of atomization and intensity of smoking taste of the aerosol-generating rod 100 (hereinafter referred to as 'parallel arrangement aerosol-generating rod') in which the tobacco strands 200 are arranged parallel to each other in the longitudinal direction in the medium portion 110 and the aerosol-generating rod (hereinafter referred to as 'random arrangement aerosol-generating rod') in which the tobacco strands 200 are arranged in a random direction in 110. The results shown in Table 1 are some of the sensory evaluation results for smokers using heating type cigarettes or heating type aerosol-generating devices. In the above-described sensory evaluation, under the condition that the elements of the aerosol-generating rod 100 are the same, except for the heating type aerosol-generating device, the temperature of the heater, and the medium portion 110, the amount of atomization and intensity of the smoking taste are respectively evaluated with different arrangements of the plurality of tobacco strands 200 constituting the medium portion 110.

The smokers who participated in the sensory evaluation visually observed the amount of atomization that has occurred, and evaluated the amount of atomization as a value between 0 and 5. In addition, the smokers participated in the sensory evaluation evaluated the taste of cigarettes based on the smell and taste, and rated the intensity of smoking taste with a value between 0 and 5.

Referring to FIG. 4 and Table 1, the average value of the sensory evaluation for the amount of atomization is 4.0 in the parallel arrangement aerosol-generating rod 100, and 1.9 in the random arrangement aerosol-generating rod. Thus, it may be seen that the parallel arrangement aerosol-generating rod 100 generates two times or more the amount of atomization generated by the random arrangement aerosol-generating rod.

Likewise, the average value of the sensory evaluation for the intensity of the smoking taste is 4.1 in the parallel arrangement aerosol-generating rod 100, and 1.8 in the random arrangement aerosol-generating rod. Thus, the parallel arrangement aerosol-generating rod 100 has two times or more the intensity of the smoking taste of the random arrangement aerosol-generating rod. Therefore, it may be seen that the parallel arrangement aerosol-generating rod 100 has an improved quality of a taste of cigarettes than the random arrangement aerosol-generating rod.

Figure 5:
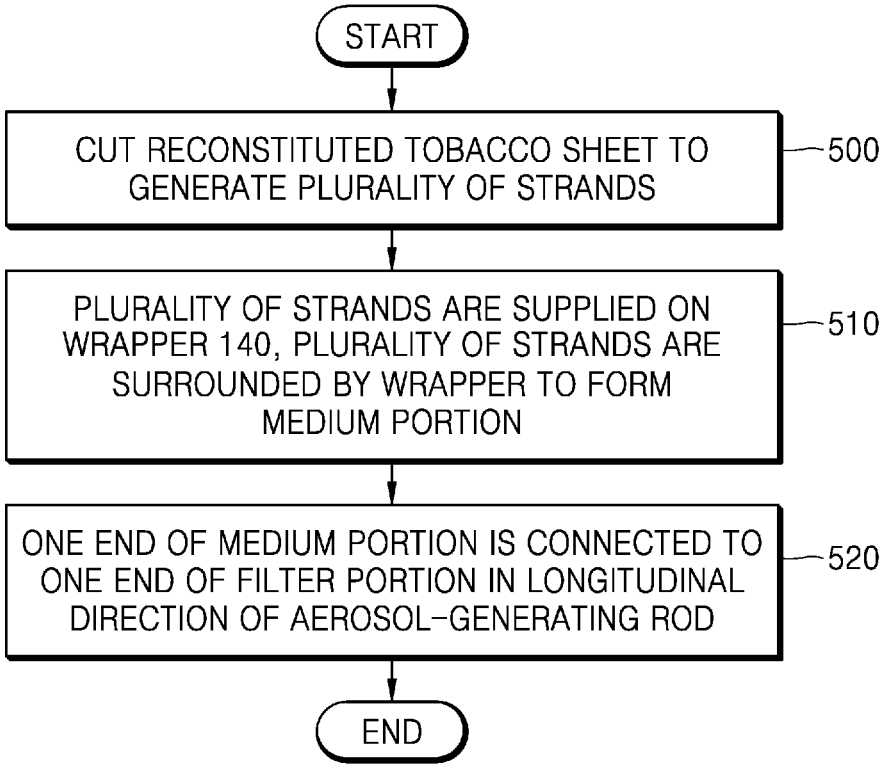
FIG. 5 is a flowchart illustrating an example of a method of manufacturing an aerosol-generating rod including a plurality of tobacco strands arranged parallel to each other in the longitudinal direction of an aerosol-generating rod.

FIG. 5 is a flowchart illustrating an example of a method of manufacturing an aerosol-generating rod including a plurality of tobacco strands arranged parallel to each other in the longitudinal direction of the aerosol-generating rod.

In step 500, the reconstituted tobacco sheet may be cut elongatedly to produce a plurality of strands. In detail, a plurality of tobacco strands 200 may be generated by cutting the reconstituted tobacco sheet formed from a slurry which is generated by crushing the tobacco raw material and then mixing with aerosol-generating substances (for example, glycerin, propylene glycol, etc.), flavoring liquids, binders (for example, guar gum, xanthan gum, carboxymethyl cellulose (CMC), etc.), and water.

In step 510, a plurality of strands may be supplied on a wrapper 140, and the plurality of strands may be surrounded by a wrapper to form the medium portion 110. In detail, the generated plurality of tobacco strands 200 may be wrapped by a porous wrapper or a non-porous wrapper to form the medium portion 110.

The plurality of tobacco strands 200 may be arranged parallel to each other in the longitudinal direction of the aerosol-generating rod 100, and wrapped by the wrapper 140. Here, the longitudinal direction means the longitudinal direction of the aerosol-generating rod 100. In other words, the medium portion 110 and the filter portion 120 constituting the aerosol-generating rod 100 are connected in the longitudinal direction, and the plurality of tobacco strands 200 may be arranged in the longitudinal direction as well.

In step 520, one end of the medium portion 110 may be connected to one end of the filter portion 120 in the longitudinal direction of the aerosol-generating rod 100. In addition, although not shown in FIG. 5, the medium portion 110 and the filter portion 120 connected to each other may be wrapped by the wrapper 140.

Those of ordinary skill in the art related to the present embodiments may understand that various changes in form and details can be made therein without departing from the scope of the characteristics described above. The disclosed methods should be considered in descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. An aerosol-generating rod comprising:

a medium portion including at least one aerosol-generating material; and a filter portion connected in a longitudinal direction to one end of the medium portion, wherein the medium portion includes a plurality of strands, and the plurality of strands comprise a cuboid shape having a rectangular cross-section, and the plurality of strands are arranged parallel to each other in the longitudinal direction, and a heater is configured to be inserted in the aerosol-generating rod in the longitudinal direction, wherein an elongated length of each of the plurality of strands corresponds to a length of the medium portion, wherein the cuboid has a width of 0.6 mm to 1.2 mm, a thickness of 0.18 mm to 0.225 mm, and a length of 10 mm to 14 mm, wherein a ratio of a mass to a surface area of each of the plurality of strands is greater than or equal to 0.05 $mg/mm^2$ and less than 0.09 $g/mm^2$, and wherein the medium portion is surrounded by a metal foil.

2. The aerosol-generating rod of claim 1, wherein the medium portion includes 100 or more of the plurality of strands, and a mass of the medium portion is 200 mg or more.

3. The aerosol-generating rod of claim 1, wherein a density of each of the plurality of strands is greater than or equal to 900 $mg/cm^3$ and less than 1100 $mg/cm^3$.

4. The aerosol-generating rod of claim 1, wherein each of the plurality of strands includes an aerosol-generating material in an amount of 15% to 25% by weight.

5. The aerosol-generating rod of claim 1, wherein each of the plurality of strands further includes at least one flavoring agent in an amount of 0.1% to 10% by weight.

6. The aerosol-generating rod of claim 1, wherein a density of the medium portion is 500 $mg/cm^3$ to 600 $mg/cm^3$.

7. A method of manufacturing an aerosol-generating rod, the method comprising:

shredding a reconstituted tobacco sheet to produce a plurality of strands;

forming a medium portion by supplying the plurality of strands onto a wrapper and wrapping the plurality of strands with the wrapper; and connecting one end of the medium portion to a filter portion in a longitudinal direction of the aerosol-generating rod, wherein the plurality of strands comprise a cuboid shape having a rectangular cross-section, and the plurality of strands are arranged parallel to each other in the longitudinal direction, and a heater is configured to be inserted in the aerosol-generating rod in the longitudinal direction, wherein an elongated length of each of the plurality of strands corresponds to a length of the medium portion, wherein the cuboid has a width of 0.6 mm to 1.2 mm, a thickness of 0.18 mm to 0.225 mm, and a length of 10 mm to 14 mm, wherein a ratio of a mass to a surface area of each of the plurality of strands is greater than or equal to 0.05 $mg/mm^2$ and less than 0.09 $g/mm^2$, and wherein the medium portion is surrounded by a metal foil.

* * * * *